United States Patent [19]

Martin

[11] 4,425,077

[45] Jan. 10, 1984

[54] TURBINE DISC ENVIRONMENT CONTROL SYSTEM

[75] Inventor: Harry F. Martin, Upper Providence, Pa.

[73] Assignee: Westinghouse Electric Corp., Pittsburgh, Pa.

[21] Appl. No.: 291,744

[22] Filed: Aug. 11, 1981

[51] Int. Cl.[3] ..... F01D 5/08

[52] U.S. Cl. ..... 415/115; 415/116; 415/176; 415/179

[58] Field of Search ..... 415/115, 116, 175, 176, 415/179; 416/181

[56] References Cited

U.S. PATENT DOCUMENTS

| | | | |
|---|---|---|---|
| 2,297,853 | 10/1942 | Zetterquist | 415/176 X |
| 2,487,514 | 11/1949 | Boestad et al. | 415/115 |
| 2,648,519 | 8/1953 | Campini | 415/116 |
| 3,306,575 | 2/1967 | Frankel | 415/115 |
| 4,113,406 | 9/1978 | Lee et al. | 415/115 |

*Primary Examiner*—Philip R. Coe
*Assistant Examiner*—Thomas W. Epting
*Attorney, Agent, or Firm*—F. J. Baehr, Jr.

[57] ABSTRACT

Ports are disposed in steam turbine blade discs to control the environment adjacent the bore of the disc to inhibit stress corrosion.

4 Claims, 3 Drawing Figures

TURBINE DISC ENVIRONMENT CONTROL SYSTEM

BACKGROUND OF THE INVENTION

This invention relates to steam turbines and more particularly to low pressure portions of the steam turbine which have blade discs shrunk on a shaft.

The low pressure stages of steam turbines operate in a wet steam environment and are manufactured with blade discs shrunk on a shaft. The high stress in the disc combined with the wet steam enhance the probability of stress corrosion which may result in cracking in the disc bores.

SUMMARY OF THE INVENTION

A steam turbine when made in accordance with this invention comprises a plurality of blade discs which are disposed serially with respect to the steam flow from a high pressure to a low pressure portion of the turbine, a plurality of ports disposed in the radially inward portion of some of the blade discs. The turbine further comprises a supply of inlet steam for the turbine and means for supplying inlet steam to the upstream side of the disc in the higher pressure portion of the turbine to provide superheated steam to downstream cavities between the discs.

BRIEF DESCRIPTION OF THE DRAWINGS

The objects and advantages of this invention will become more apparent from reading the following detailed description in conjunction with the accompanying drawings, in which.

DESCRIPTION OF THE PREFERRED EMBODIMENT

Figure 1:
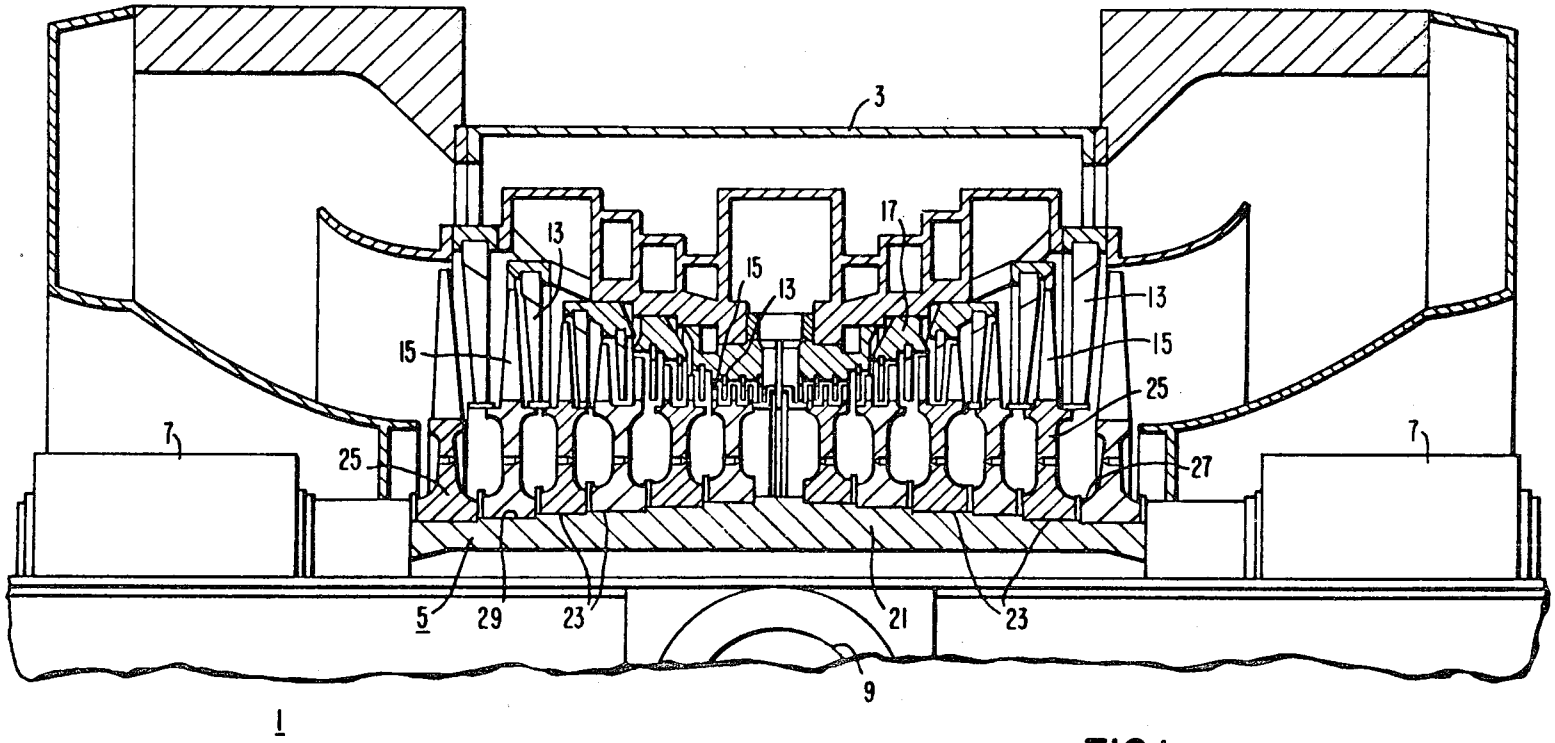
FIG. 1 is a partial sectional view of a low pressure turbine made in accordance with this invention.

Referring now to the drawings in detail and in particular to FIG. 1, there is shown a low pressure steam turbine or elastic fluid machine 1 which comprises an enclosed housing or casing 3 with a rotor 5 disposed therein. The casing 3 has journal bearings 7 disposed on opposite ends thereof for rotatably supporting the rotor 5 within the casing 3. A steam inlet nozzle 9 is disposed in the central portion of the casing to supply steam to circular rays pf stationary and rotatable blades 13 and 15, respectively, affixed to the casing 3 and the rotor 5. The stationary blades are disposed in blade rings or diaphragms 17 which attach to the casing producing pressure stages as the steam expands through the turbine 1. The casing 3, journal bearing 7 and blade diaphragm 17 are split horizontally so that the upper portion of the casing 3 may be removed to permit removal of the rotor 5.

The rotor 5 comprises a shaft having a plurality of circumferential steps 23, which ascend from each end thereof. Disposed on the circumferential steps 23 are blade discs 25, which have a central hub portion 27 and one or more circular arrays of rotatable blades 15 affixed to the outer periphery thereof. The hubs 27 each have a central bore 29 sized to fit a particular or mating step 23 on the shaft 21. The bore 29 is normally slightly smaller than the diameter of mating step 23 over which it slides producing an interference or shrink fit therebetween. Steam flows outwardly in both directions from the center of the turbine and is reduced in pressure as it passes the various stages of the turbine which consist of sets of stationary and rotating blades.

Figure 3:
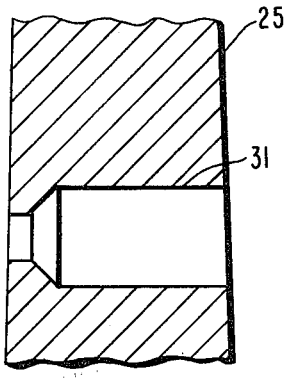
FIG. 3 is an enlarged, partial sectional view of a port disposed in the disc.

A port 31 is disposed in the radially inner portion of the disc 25. As shown best in FIG. 3, the ports 31 have a large outlet compared to the inlet. The ports 31 are formed by boring a hole of a predetermined size in the disc 25 and counterboring the hole from the downstream side of the disc to form a thin wall orifice at the inlet end of the port 31.

Figure 2:
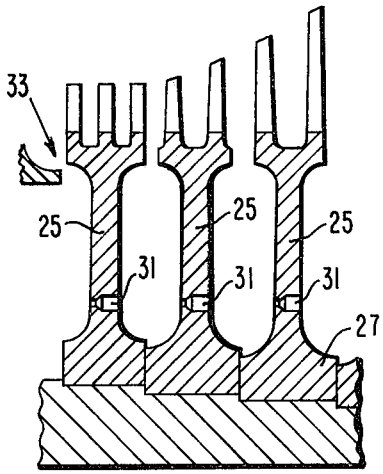
FIG. 2 is an enlarged, partial sectional view of blade discs.

As shown in FIG. 2, inlet steam is supplied to the upstream side of the high pressure higher pressure disc by increasing the clearance between the inlet nozzle and the first row of rotatable blades as indicated generally at 33. The radial position of the ports may be varied in succeeding rows along with the size of the ports to achieve some mixing of the steam passing through the ports 31 with the blade flow steam in order to control downstream temperature of the disc. Even if saturated steam is supplied to the turbine inlet, the ports 31 throttle the steam passing therethrough to produce superheated steam at a lower pressure in the next cavity. The ports' shape also prevents condensation in the downstream portions of the ports due to the axial thermal gradients that may exist in the discs. The rapid pressure drop through the ports 31 insures disc temperature higher than the local saturation temperature providing a water-free environment to inhibit stress corrosion.

What is claimed is:

1. A steam turbine comprising a plurality of rotatable blade discs so shaped and having a bore which fits tightly on a shaft to form a rotor with a generally closed cavity between adjacent rotatable discs, the cavities being disposed serially with respect to the steam flow from a high pressure to a low pressure portion of said turbine; a plurality of ports disposed in a radially inward portion of said rotatable blade discs; a supply of high pressure inlet steam for said turbine; and means for supplying said high pressure inlet steam to the upstream side of said rotatable blade discs in the higher pressure portion of said turbine; said ports being a predetermined size and so disposed that steam entering each of said serially disposed downstream cavities through said ports is throttled and thus superheated to eliminate moisture in the rotor cavities and thereby inhibiting stress corrosion adjacent the bore of said rotatable blade discs.

2. A steam turbine as set forth in claim 1, wherein the ports are bored holes in the disc, said holes being counterbored on the downstream side thereof to form a thin wall orifice at the inlet end of each port.

3. A steam turbine as set forth in claim 1, wherein the ports have a large outlet compared to their inlet.

4. A steam turbine comprising a plurality of rotatable blade discs so shaped and having a bore which fits tightly on a shaft to form a rotor with a generally closed cavity between adjacent discs, the cavities being disposed serially with respect to steam flow from a high pressure to a low pressure portion of said turbine and means for providing steam decreasing in pressure in said serially disposed cavities from said high pressure portion to said low pressure portion of said turbine and for providing a superheated condition of said steam in each of the said cavities to eliminate moisture in the cavities and thereby inhibit stress corrosion adjacent the bore of said rotatable blade discs.

* * * * *